US005749517A

United States Patent [19]

Dupre

[11] Patent Number: 5,749,517

[45] Date of Patent: May 12, 1998

[54] CONTROL SYSTEM FOR SNOW MAKING DEVICES

[76] Inventor: Herman K. Dupre, c/o Seven Springs, Champion, Pa. 15622

[21] Appl. No.: 813,412

[22] Filed: Mar. 10, 1997

Related U.S. Application Data

[63] Continuation-in-part of Ser. No. 633,128, Apr. 16, 1996, which is a continuation-in-part of Ser. No. 534,837, Sep. 27, 1995, Pat. No. 5,628,456.

[51] Int. Cl.[6] ..... F25C 3/04; F16K 11/14; F16K 31/12

[52] U.S. Cl. ..... 239/14.2; 137/869; 251/58

[58] Field of Search ..... 239/2.2, 14.2, 239/412, 414, 415, 417.5; 137/869, 894, 607; 251/58

[56] References Cited

U.S. PATENT DOCUMENTS

| | | | |
|---|---|---|---|
| 3,801,062 | 4/1974 | Arn et al. | 251/58 X |
| 3,814,319 | 6/1974 | Loomis | 239/2 S |
| 4,545,529 | 10/1985 | Tropeano et al. | 239/2 |
| 4,635,852 | 1/1987 | Muhlnickel, Jr. | 239/414 |
| 4,717,072 | 1/1988 | Girardin | 239/415 X |
| 4,749,127 | 6/1988 | Ash | 239/14.2 |
| 5,031,832 | 7/1991 | Ratnik et al. | 239/14.2 |
| 5,154,348 | 10/1992 | Ratnik et al. | 239/14 |
| 5,360,163 | 11/1994 | Dupre | 239/14 |
| 5,538,184 | 7/1996 | Karbanowicz et al. | 239/14.2 |

FOREIGN PATENT DOCUMENTS

| | | |
|---|---|---|
| 0479641A1 | 9/1991 | European Pat. Off. . |
| 2623276 | 12/1987 | France . |

*Primary Examiner*—Andres Kashnikow
*Assistant Examiner*—Robin O. Evans
*Attorney, Agent, or Firm*—Carothers & Carothers

[57] ABSTRACT

A snow making system which includes a snow making device adapted to produce a spray of artificially manufactured snow from a combination of compressed air and water supplied under pressure to the device from remote compressed air and water supplies. A control system is provided at each snow making device which includes air and water valves that are operatively connected between the snow making device and respective supplies of compressed air and water for controlling the supply of air and water to the snow making device. The air and water valves are ganged together for simultaneously valving of the air and water supply and these valves are further adapted for draining water from the connected snow making device when the valves are in their off position. An air operated drive is connected for actuating the ganged valves simultaneously and is connected to the air supplied under pressure for maintaining the ganged valves on when the pressure of the supplied air is above a predetermined minimum. The ganged valves have a ganged lever operating mechanism which is weighted for turning off the ganged valves when predetermined minimum air pressure is attained. The air operated drive also self drains to remove moisture.

23 Claims, 3 Drawing Sheets

CONTROL SYSTEM FOR SNOW MAKING DEVICES

CROSS REFERENCES

This patent application is a continuation-in-part of U.S. patent application Ser. No. 08/633,128, filed on Apr. 16, 1996 in the name of Herman K. Dupre for CONTROL SYSTEM FOR SNOW MAKING DEVICES, which in turn is a continuation-in-part of U.S. patent application Ser. No. 08/534,837, now U.S. Pat. No. 5,628,456, filed on Sep. 27, 1995 in the name of Herman K. Dupre for BELOW SURFACE CONTROL SYSTEM FOR SNOW MAKING DEVICES.

BACKGROUND OF THE INVENTION

This invention relates to the art of making snow for ski resorts and the like. More particularly, it relates to improvements in apparatus utilized to control snow making devices for manufacturing snow for ski resorts.

It is well known that ski resorts utilize a series of snow towers and/or snow guns on the ski slopes in order to manufacture snow with the combined use of water under pressure and compressed air in subfreezing conditions.

Ski resorts maintain crews of equipment operators whose job it is to travel the mountain sides to turn the snow making equipment on or off and to make other adjustments as required in order to maximize the manufacture of man-made snow and to minimize waste of such manufactured snow. This requires the operator to move from snow making tower to tower or gun to gun in order to adjust or turn on and off the air and water valves supplying the respective snow making devices.

These exposed valves are generally mounted adjacent each snow tower on an air-water hydrant and are therefore subject to freezing and jamming due to freezing. They also present a year-around unwanted obstruction.

Additionally, the operator usually travels from tower to tower by snowmobile or an all-terrain vehicle and the setup at each tower is such that the operator is required to park and get off his vehicle, approach the tower and then free the water and air valves from snow and ice which are covering them and then manipulate each valve independently.

When there are many towers or snow guns on the ski slopes to maintain, this operation requires more than a considerable amount of the operator's time. In addition, the valves and/or lines may be found in a frozen condition and additional labor has to be expended in unfreezing the valve so that they can be manipulated.

Also, if the snow making device is being turned off, an additional drain valve must either be turned on or the water line actually disconnected from the hydrant to drain all water from the snow making device. Moisture can also accumulate in the air supply line and generally it must be also drained in order to prevent freeze-up in the supply lines from the hydrant to the snow making device. This all, of course, requires an unreasonable amount of expended labor which is costly.

In addition, when an operator disconnects the water and air supply lines which lead from the hydrant to the snow making device for draining the same when turning it off, the water and air supply lines can be easily mixed up and connected to the wrong supply upon reconnection and activation of the tower. The result is that the operator moves on and does not realize at the time that the snow making device is not operating correctly and that it is merely providing unwanted ice conditions on the ski slope.

Another major drawback of the snow making systems of the prior art for ski resorts is that in the off ski season when it is desired to use the ski slopes for other activities such as hiking or summer down-hill sports or activities, the hydrants of the prior art still protrude above ground as a hazardous condition as do the snow making towers or equipment itself. The hydrants are also expensive to manufacture.

It is a principal object of the present invention to provide a snow making system for ski resorts which in the off season leaves no objectional hazardous protrusions extending above the ski slope ground surface and provides a protected control system therefore which can be very easily and quickly attended to by an operator, remotely operated and prevents freeze-up of the valves and additionally automatically drains the snow making device when it is in an off condition.

SUMMARY OF THE INVENTION

The snow making system of the present invention includes a snow making device, such as a tower or gun, which is adapted to produce a spray of artificially manufactured snow from a combination of compressed air and water supplied under pressure from remote compressed air and water supplies. Air and water valves are operatively connected between the snow making device and the respective supplies of compressed air and water for controlling the supply of air and water to the snow making device.

The air and water valves are ganged together for simultaneous valving of the air and water supply and these valves are adapted for draining water from the connected snow making device when the valves are in their off position.

An air operated drive, such as a piston cylinder combination, is connected for actuating these ganged valves simultaneously and connected to the air supplied under pressure for maintaining the ganged valves on when the pressure of the supplied air is above a predetermined minimum. The ganged valves have a ganged lever operating mechanism or arm which is weighted for turning off the ganged valves when the predetermined minimum air pressure is attained.

The air operated drive is an air actuated piston-cylinder arrangement which is preferably double-acting with pressure chambers in the cylinder on opposite sides of an actuating piston. The piston is provided with a downwardly depending piston rod extending from the cylinder and connected for actuation to the ganged valves through the ganged lever operating mechanism or arm.

These pressure chambers in the cylinder provide upper and lower pressure chambers respectively and exhaust air flow regulators are connected to these air chambers respectively for regulating the flow of air exhausting therefrom to thereby regulate the speed for opening and closing the ganged valves.

In addition, the air connection to this piston-cylinder arrangement is provided in the bottom portion of the lower pressure chamber whereby any moisture in this lower pressure chamber will automatically gravity drain therefrom through the connection.

An air control valve is preferably operatively connected between this air operated drive and the air supplied under pressure for selectively connecting the drive to the air supplied under pressure. This permits selective automatic or alternatively manual operation of the ganged valves. The air control valve is also a three way valve whereby it is adapted for draining air and water remaining in the air operated drive when the control valve is in an off position, which requires manual operation of the ganged valves. Three-way air valve may be operated from a remote location by computer as by electric solenoid. A bypass valve may also be included to bypass this three-way error control valve for manual bypass in the event of a remote control failure.

The ganged valves include a single handle connected for simultaneous manual operation of the valves. A lock mechanism is provided for selectively locking the handle in an off or on position.

It is preferred that the ganged valves be enclosed in a below ground control pit which has a removable access lid and a bottom water drain mechanism for draining off water. The handle for manual operation is exposed through and above the lid for manual manipulation. The handle may be extended in length above the lid for access thereto when snow accumulation on the ground surface becomes excessive.

The handle is pivotly connected to the ganged lever operating mechanism whereby the ganged lever operating mechanism is permitted to pivot relative to the handle thereby permitting self alignment or adjustment of the ganged lever operating mechanism to compensate for differences in on and off positions of the ganged valves. In other words, many times valves assume different physical operating positions of on and off after use or wear and this mechanism allows for such variations in the, or between the, air and water operating valves.

While the system of the present invention will work well with any snow making device, it is preferably adapted for and utilized with number of stationary snow making towers arranged on the ski slope.

The pipes or conduits utilized to connect the ganged valves to the snow making device are preferably metal, such as aluminum, so that as they extend upwardly in the control pit, they engage each other for heat transfer for preventing the air pipe from freezing. These hydrant pipes upwardly terminate below the control pit lid with 45° connection air and water elbows for hose connection through the control pit side and onto the snow making device. This arrangement permits full gravity draining of the snow making device when the ganged valves are in their off position, as no accumulation of water is permitted anywhere in the system during the draining process. In addition, the hydrant air elbow is positioned directly above the hydrant water elbow for heat transfer which also assists in preventing the air connection from freezing.

The ganged air and water valves include a water valve having a straight through passage. This permits limited restriction of the water flow and allows maximum water pressure supply to the snow making device. In addition, the water valve is also provided with a spring biased check valve on the snow making device side of the water valve which drains water from the snow making device when the water pressure supplied thereto attains a predetermined minimum. This entire water valve mechanism is used in substitution of a conventional three-way valve.

It is preferable that a male hose connector be provided on one of the air and water elbows and a female hose connector be provided on the other elbow for thereby preventing reverse connection of air and water hoses for the snow making device. Removable caps are also provided to close off these hose connectors when the snow making devices are not in use.

In order to keep the underground control pit sufficiently warm so that pipes do not freeze, insulation may be disposed in the pit enclosure and in addition the air and water supplied under pressure to the pit is preferably supplied with aluminum piping, at least in the pit enclosure area, for maximum heat transfer.

As previously explained, the system may be operated in automatic mode wherein the snow making devices are turned off when a predetermined minimum air pressure is attained. Generally this minimum air pressure is adjusted to be approximately sixty to eighty pounds per square inch, as air pressures less than this are not sufficient for the artificial manufacture of snow.

The air control valve may be electrically operated by a remotely located electric control or computer connected for actuating the air control valve. In addition this valve may also be manually operated to a permanent on or off condition at the site of each snow making device.

A water pressure regulator valve may also be provided at each snow making device location so that the water supply may be regulated, as by gate valves, to regulate the pressure of the water supplied from the water supply to the respective snow making devices. This permits fine regulation for the snow making capabilities at different locations along the ski slope. For example, under the existing ambient conditions, it may be preferable to supply less water pressure at the base of the mountain or ski slope than at the top, as obviously under normal conditions the water pressure at the bottom of the mountain which is supplied to the snow making devices would be much greater than that the water under pressure supplied to the snow making devices at the top of the mountain or ski slope.

In order to automatically close the ganged valves when the air pressure supplied is less than the aforesaid predetermined minimum, weights are positioned and adapted to close the ganged valves when the air drive is no longer under sufficient operation pressure to oppose the weights on the ganged lever and maintain the valves in their open position. Different weights of different magnitude may be substituted for thereby regulating the predetermined minimum air pressure at which the system will automatically shut down.

BRIEF DESCRIPTION OF THE DRAWINGS

Other objects and advantages appear in the following description and claims. The accompanying drawings show, for the purpose of exemplification, without limiting the invention or claims thereto, certain practical embodiments illustrating the principals of this invention wherein:

DETAILED DESCRIPTION OF A PREFERRED EMBODIMENT

Figure 1:
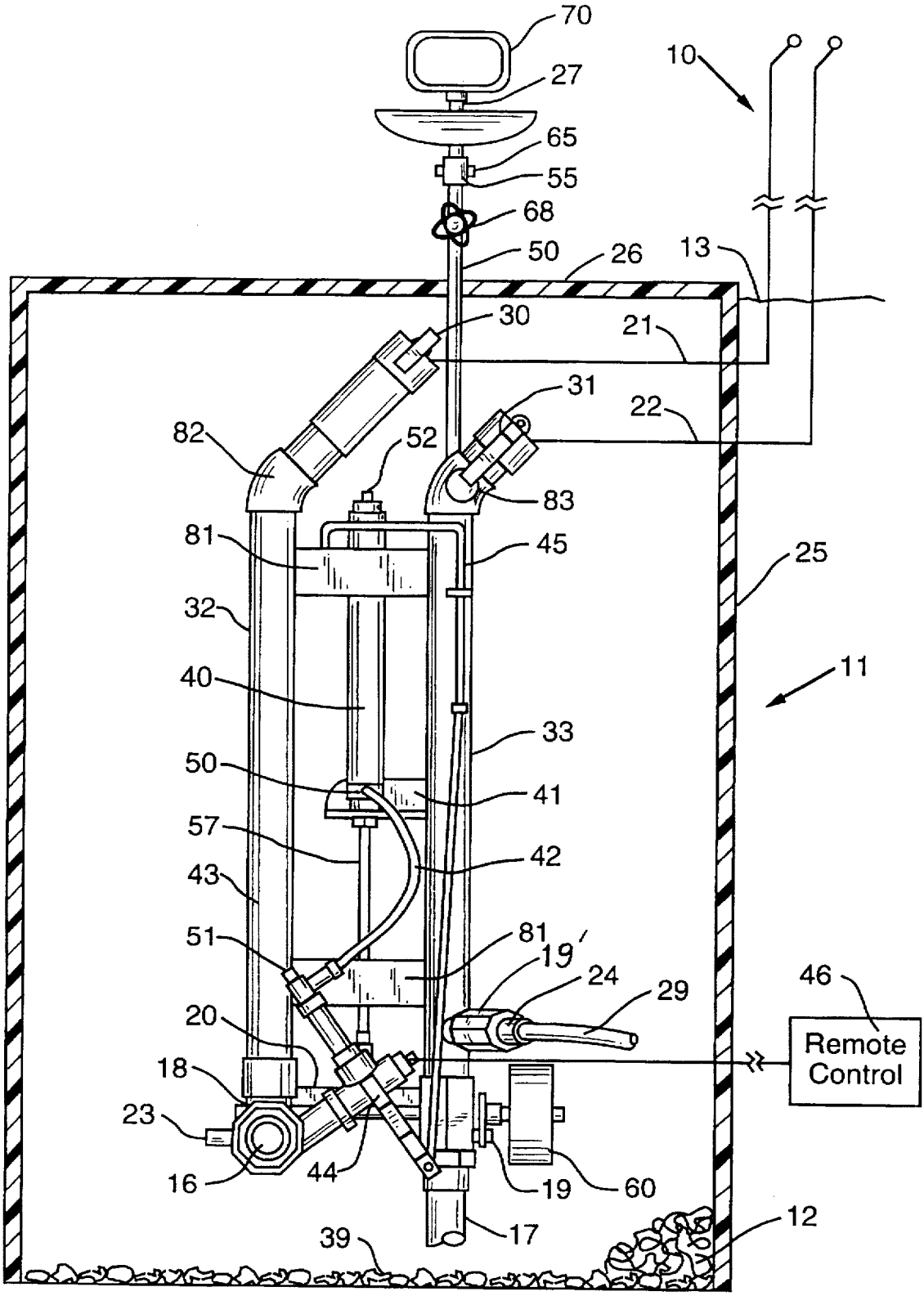
FIG. 1 is a view in front elevation, with portions sectioned away and other portions shown schematically, illustrating the control system of the present invention.
Figure 2:
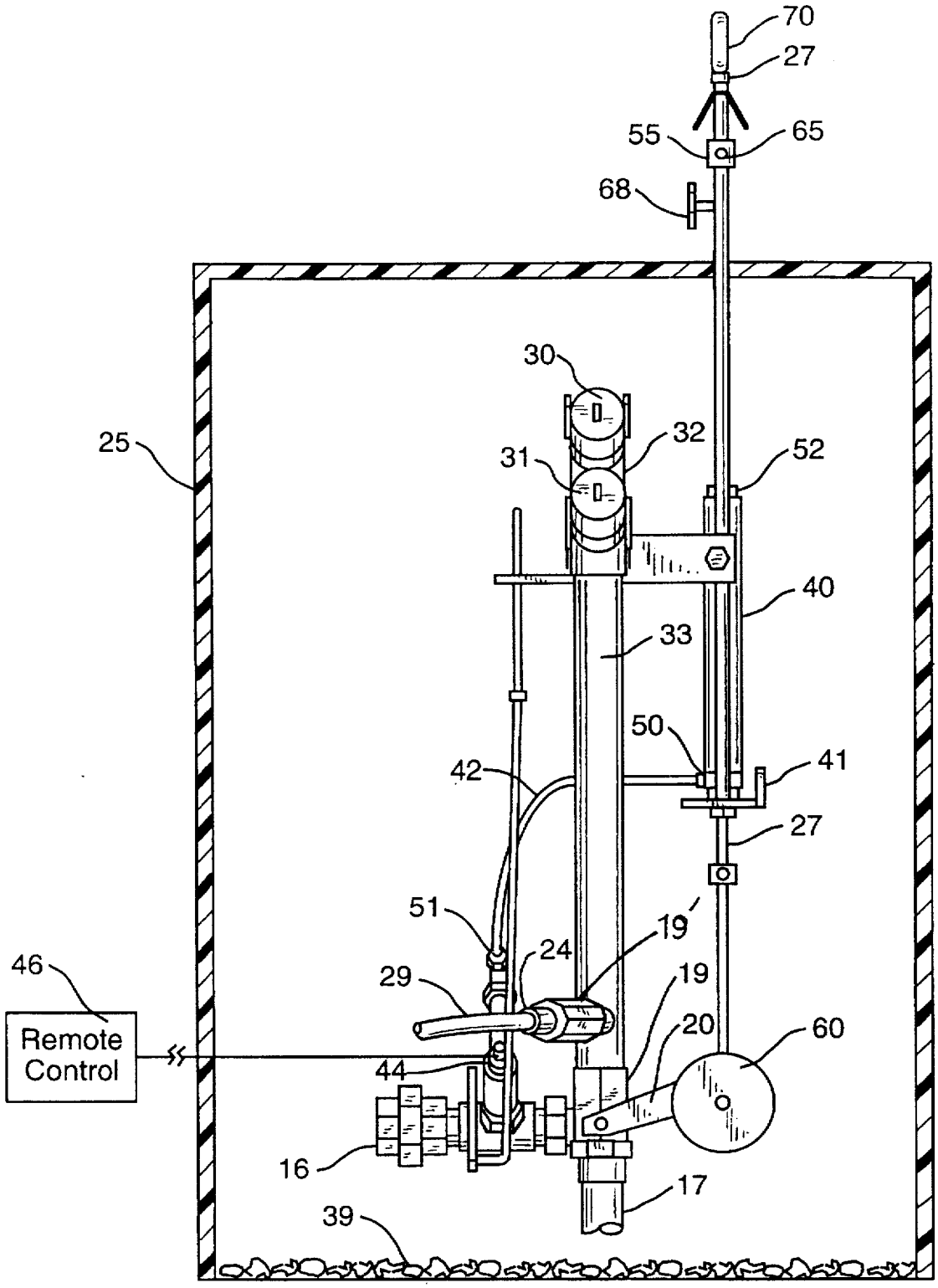
FIG. 2 is a view in right side elevation of the control system shown in FIG. 1.
Figure 3:
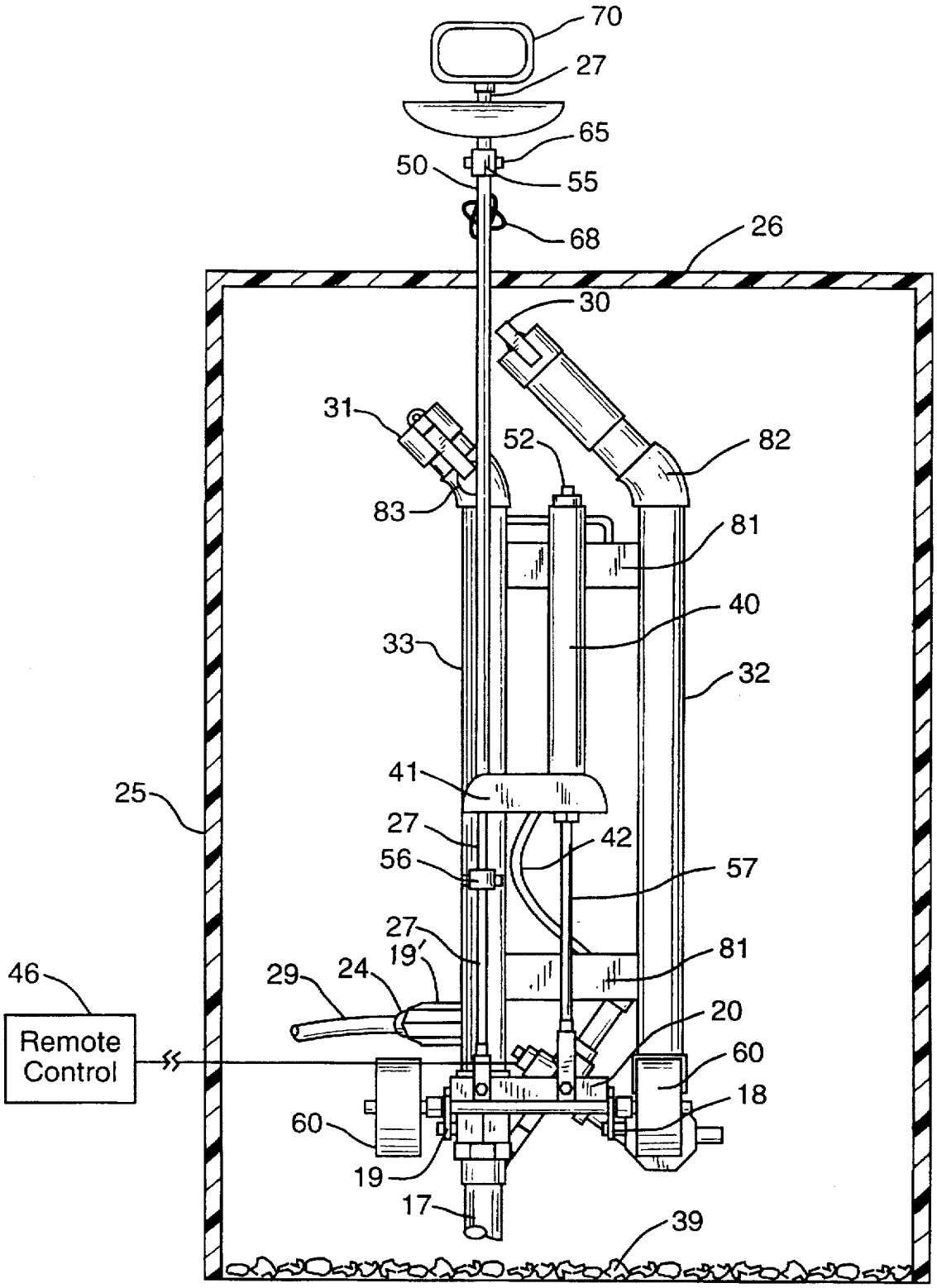
FIG. 3 is a view in back elevation of the control system shown in FIG. 1.

Referring to FIGS. 1, 2 and 3, a snow making system is illustrated wherein a snow making device is schematically illustrated in the form of a snow making tower 10 in combination with an air and water control feed mechanism I 1 which supplies the snow tower 10.

The schematically illustrated snow making tower 10 is of the same type illustrated in Dupre U.S. Pat. No. 5,360,163 and is removably embedded in the ski slope ground surface 13.

Compressed air and water under pressure are respectively provided from remote locations and in conventional fashion to snow tower 10 through underground lines 16 and 17. These lines continue on to other controls 11 along the ski slope for supplying additional snow towers 10.

The supply of air and water to snow tower 10 from the respective air and water lines 16 and 17 are controlled respectively by three-way valve 18 and straight valve 19. These valves are ganged together by double operating arm or lever operating mechanism 20 for simultaneous operation or valving of the air and water supply. Adjustable stops for arm or lever operating mechanism 20 may be provided for upper and lower swing limits as required and as illustrated in my copending application.

Each of these valves 18 and 19 is adapted for draining water from snow tower 10 to respective air and water connection hoses 21 and 22 (schematically illustrated in FIG. 3) by respective drains 23 and 24 when valves 18 and 19 are in their off position. Hoses 21 and 22 may extend as far as desired through the side of pit enclosure 25 for connection to tower 10.

Air valve 18 is a three-way valve which drains off all moisture from the air line through drain outlet 23 when air control valve 18 is in the off position. Water valve 19 is a conventional water valve having a straight through passage and is further provided with a spring biased check valve 19' which is a spring biased check valve on the snow making device side of the water valve 19 which drains water from the snow making device 10 when the water pressure supplied thereto attains a predetermined minimum. This arrangement permits minimum restriction to flow of water through valve 19.

Valves 18 and 19 are housed in underground control pit enclosure 25 which is basically a plastic cylinder constructed of any suitable plastic, such as, polyurethane of polyvinyl chloride. Pit enclosure housing 25 is also provided with a mating cap or lid 26 to close off the top. The bottom 39 is gravel or crushed stone for drainage to prevent water accumulation. The enclosure 25 may be filled with insulation, such as rock wool 12 to help prevent freeze-up in the enclosed valves and pipes.

A single control handle 27 extends through lid 26 and is removably connected to control lever 20 to simultaneously operate valves 18 and 19 above ground by manipulation of the handle. When handle 27 is in the up position as shown, the three-way valves 18 and 19 are on and water and air under pressure are being supplied through hoses 21 and 22 from exposed hydrant pipes 32 and 33 to snow tower 10. When the valves are off, water drains out of air connection hose 21 through drain 23 and out of water connection hose 22 through water drain 24. Air drain 23 is restricted so that the air contained therein under very high pressure does not escape too fast and thereby disturb the interior of enclosure 25 and undesirably blow off lid 26. Drain pipe 29 which is connected to drain 24, drains off the water to a location outside enclosure 25 so that the enclosure is not unduly flooded, this permits gravity drainage of all water (approximately 10 gallons) from tower 10 through connection hose 29 to an outside downhill location.

Air coupling 30 of air hydrant pipe 32 is a male coupler part and the coupling 31 for water hydrant pipe 33 is a female coupling part so that it is impossible for the operator to inadvertently reverse connection of the lines to snow tower 10. By using a male coupler 30 for the air line, it has been found that the air coupling seal ring (not shown) is not inadvertently blown out on disconnect and thereby lost. The couplings 30 and 31 are conventional quick-connect and disconnect couplings such as manufactured under the trademark EVERTITE. The couplings are also provided with respective end caps (not shown), which hang nearby for ready access to cap off the couplings 30 and 31 when not in use.

In the spring, summer and fall seasons, or the off ski season, the handles 27 and 45 can be quickly disconnected and dropped down into housing or enclosure 25 for storage until needed again in the winter. Hydrant pipes 32 and 33 are already housed in the pit.

In this situation, the top 26 remains on the enclosure 25 and presents a continuous above ground surface without hazardous protrusions projecting therefrom. Accordingly, when snow tower 10 is removed and handles 27 and 45, are removed, a nonhazardous ground surface is provided which is usable for summer downhill activities. Alternatively, an extra plastic bubble cover (not shown) may be provided to cover over the remaining parts exposed above lid 26.

An air operated drive 40, provided in the form of an air operated cylinder and piston combination, is connected between control arm 27 and a stationary support base 41 for actuating the ganged valves 18 and 19 simultaneously when the pressure of the supplied air, supplied through line 16, is above a predetermined minimum due to weights 60.

Air under pressure to operate drive 40 is supplied via hose 42 from air line 16 through lower air hydrant pipe 43. The supply of this air under pressure from line 43 through hose 42 is controlled by air valve 44. Air valve 44 is solenoid operated and can be either controlled independently and manually at its location through exposed control handle 45 or remotely through a computer or other electric or electronic control 46.

When air control valve 44 is turned to its off position by handle 45, the snow tower 10 cannot be turned on, except manually through manipulation of handle 27. If air control valve 44 is on, tower 10 will automatically be turned on by turning on ganged valves 18 and 19 simultaneously when minimum air pressure is attained thereby extending the piston cylinder arrangement 40 to lift arm 20 due to weights 60 and simultaneously actuate both air and water valves 18 and 19.

Air control valve 44 is also a three-way valve so that when it is in its off position, all moisture or condensation or water contained in air drive 40 is automatically gravity drained therefrom into pit enclosure 25.

A lock mechanism 68 is provided for selectively manually locking control arm or handle 27 in an off or on position for the respectively ganged and control valves 18 and 19.

Upper and lower stops 55 and 56 respectively are positioned on and secured to arm 27 to set upper and lower limits of movement for ganged lever 20.

When the ganged valves 18 and 19 are turned on automatically by the air operated drive 40, the piston arm 57 thereof extends and forces handle 27 upwardly until bottom stop 56 engages the bottom of lock sleeve 50. The valves are then in their full on position.

When the air supplied under pressure through line 16 reaches a predetermined minimum, of say 60 to 80 psi, the air pressure within the cylinder of air drive 40 will sufficiently decrease so that weight 60 is sufficient to draw control arm 27 downwardly and force piston rod 57 into the cylinder of air drive 40 to collapse the drive and to thereby lower dual arm 20 due to weights 60 and close off both air and water valves 18 and 19 simultaneously. The lower most limit of downward extension for control arm 27 is limited by the contact of upper stop 55 against the top of sleeve 50.

The air operated drive is in the form of air actuated piston-cylinder arrangement 40 which is a double acting piston-cylinder arrangement with pressure chambers in the cylinder 40 on opposite sides of an actuating piston. The piston is provided with the downwardly depending piston rod 57 which extends from the cylinder and is pivotally connected to lever 20 for actuation of the ganged valves 18 and 19 through ganged lever operating mechanism or arm 20.

An air connection 50 is provided for supplying air under pressure for operating piston-cylinder arrangement 40. This connection 50 is provided a bottom of the lower pressure chamber in piston-cylinder arrangement 40 whereby any moisture in the lower pressure chamber thereof will gravity drain therefrom through hose connection 50 and hose 42.

The pressure chambers within piston-cylinder arrangement 40, as previously indicated, provide upper and lower pressure chambers (not shown) on the interior of drive 40. Exhaust air flow regulators 51 and 52 respectively are connected to the lower air chamber and the upper air chamber of air drive 40 for regulating the flow respectively of air exhausting therefrom to thereby regulate the speed for opening and closing the ganged valves.

In the event that snow buildup is extensive on top of ground surface 13, an extension for handle 70 may be provided for control arm 27. A similar handle extension may also be provided for air control arm 45. This extension for arm 27 would merely thread at opposite ends into the existing handle 70 and control arm 27.

The hydrant air and water pipes 32 and 33 are metallic, and preferably aluminum, and are engaged with each through welded heat transfer plates 81 so that heat transfers from the water pipe to the air pipe to prevent freezing. In addition, the hydrant pipes upwardly terminate with 45° connection air and water elbows 82 and 83. This arrangement permits hoses 21 and 22 to be fully positioned above pipes 32 and 33 so that there is full gravity draining of all water from snow tower 10 when the ganged valves 18 and 19 are in their off position. In addition, hydrant air elbow 82 with its corresponding coupler 30 is positioned directly above the hydrant water elbow 83 with its respective coupler 31 so that upwardly rising heat is transferred from the water coupling to the air coupling in order to further assist in preventing freeze-up of the air coupling.

All piping within the closure 25 is preferably metal and more preferably aluminum in order to provide for maximum heat transfer within the enclosure 25 to prevent freeze-up.

The predetermined minimum air pressure for automatically actuating the control was before described as being approximately 60 to 80 pounds per square inch. The reason for this is that when the air pressure drops below 80 psi, snow can no longer be artificially manufactured with the snow making device 10.

I claim:

1. In a snow making system including a snow making device for producing a spray of artificially manufactured snow from a combination of compressed air and water supplied under pressure thereto from remote compressed air and water supplies, air and water valves operatively connected between said snow making device and the respective supplies of compressed air and water for controlling the supply of air and water to the snow making device, said air and water valves ganged for simultaneous valving of the air and water supply and said valves adapted for draining water from the connected snow making device when said valves are in their off position, an air operated drive connected for actuating said ganged valves simultaneously and connected to said air supplied under pressure for maintaining said ganged valves on when the pressure of said supplied air is above a predetermined minimum, the improvement comprising: said ganged valves having a ganged lever operating mechanism which is weighted for turning off said ganged valves when said predetermined minimum air pressure is attained.

2. The snow making system of claim 1 wherein said air operated drive is an air actuated piston-cylinder arrangement.

3. The snow making system of claim 2 wherein said piston-cylinder arrangement is double acting with pressure chambers in a cylinder on opposite sides of an actuating piston and said piston having a downwardly depending piston rod extending from said cylinder and connected for actuation of said ganged valves through said ganged lever operating mechanism.

4. The snow making system of claim 3, said pressure chambers providing an upper and a lower pressure chamber, and exhaust air flow regulators respectively connected to said air chambers for regulating the flow of air exhausting therefrom and thereby regulating the speed for opening and closing said ganged valves.

5. The snow making system of claim 3, said pressure chambers providing an upper and a lower pressure chamber, and an air connection for supplying air under pressure for operating said piston-cylinder arrangement, said connection provided in a bottom portion of said lower pressure chamber whereby any moisture in said lower pressure chamber will gravity drain therefrom through said connection.

6. The snow making system of claim 5 including an electrically operated three-way air valve in said air connection for turning the supply of air to said piston-cylinder arrangement on and off from a remote location and for draining and exhausting said piston-cylinder arrangement when said three-way air valve is off.

7. The snow making system of claim 1, wherein said predetermined minimum air pressure is approximately 60 pounds per square inch.

8. The snow making system of claim 6 including a single handle connected to said ganged lever operating mechanism for simultaneously manually operating said ganged valves.

9. The snow making system of claim 8, including a lock mechanism for selectively locking said handle in an off or on position for said ganged valves.

10. The snow making system of claim 9 wherein said handle is pivotally connected to said ganged lever operating mechanism whereby said ganged lever operating mechanism is permitted to pivot relative to said handle whereby permitting self-adjustment of said mechanism for differences in on and off positions of said ganged valves.

11. The snow making system of claim 10, including a control pit enclosure enclosing said ganged valves below a ground surface and having a removable access lid and bottom water drain mechanism for draining off water, said handle exposed through and above said lid for manual manipulation.

12. The snow making system of claim 11 including extension means adapted for extending the length of said handle above said lid.

13. The snow making system of claim 12, said handle including stops providing upper and lower stop limits of movement for said handle.

14. The snow making system of claim of claim 11 including metal air and water hydrant pipes for connecting said ganged valves to said snow making device, said pipes confined within said control pit and connected to each other for heat transfer therebetween for preventing said air pipe from freezing.

15. The snow making system of claim 14, said hydrant pipes upwardly terminating with 45° connection air and water elbows for hose connection to said snow making device for providing full gravity draining of said snow making device when said ganged valves are off.

16. The snow making system of claim 15 wherein the hydrant air elbow is positioned directly above the hydrant water elbow for heat transfer.

17. The snow making system of claim 16 including a male hose connector on one of said air and water elbows and a female hose connector on the other elbow for preventing reverse connection of air and water hoses for said snow making device.

18. The snow making system of claim 1 wherein said ganged air and water valve include a water valves having straight through passages and a spring biased check valve on the snow making device side of said water valve which drains water from said snow making device when the water pressure supplied thereto attains a predetermined minimum.

19. The snow making system of claim 14 including an additional water valve in said water hydrant pipe for selectively diverting additional water to said snow making device.

20. The snow making system of claim 11, including insulation disposed in said pit enclosure.

21. The snow making system of claim 11, wherein said air and water supplied under pressure is supplied with aluminum pipe, in said pit enclosure for maximum heat transfer.

22. The snow making system of claim 1 wherein said ganged lever operating mechanism is weighted with at least one removable weight of preselected value.

23. The snow making system of claim 18 including a drain hose on said water check valve for draining water therefrom to an area external of said pit enclosure.

* * * * *